United States Patent [19]

Schneider

[11] 3,937,396

[45] Feb. 10, 1976

[54] VALVE FOR VENTED PACKAGE

[76] Inventor: William S. Schneider, 10 Goodwill Road Extension, Weston, Conn. 06880

[22] Filed: Jan. 18, 1974

[21] Appl. No.: 434,611

[52] U.S. Cl. ..... 229/62.5; 229/DIG. 14; 229/48 T; 426/118

[51] Int. Cl.[2] ..... B65D 31/14

[58] Field of Search ..... 229/DIG. 14, 62.5, 53, 229/66, 48 T; 150/9; 426/118, 395, 412

[56] References Cited

UNITED STATES PATENTS

| | | | |
|---|---|---|---|
| 2,361,344 | 10/1944 | Yates | 229/DIG. 14 |
| 3,108,881 | 10/1963 | Shaw et al. | 426/412 |
| 3,123,210 | 3/1964 | Hermanson et al. | 229/48 T |
| 3,237,844 | 3/1966 | Hughes | 229/62.5 X |
| 3,502,487 | 3/1970 | Byrd | 229/62.5 X |
| 3,637,132 | 1/1972 | Gray | 229/DIG. 14 |

FOREIGN PATENTS OR APPLICATIONS

| | | | |
|---|---|---|---|
| 831,846 | 1/1970 | Canada | 229/DIG. 14 |

*Primary Examiner*—William T. Dixson, Jr.
*Assistant Examiner*—Stephen P. Garbe
*Attorney, Agent, or Firm*—Diller, Brown, Ramik & Wight

[57] ABSTRACT

This disclosure relates to a vent valve arrangement for a sealed package wherein when excessive pressures occur within the sealed package, gases will automatically be vented therefrom. The vent valve includes at least one perforation in the package with the perforation being formed through one of two walls of the package into the interior thereof and there being a resistance path from the interior of the package to the perforation with the resistance path being openable by forces expanding the walls whereby pressure that is caused by the formation of gases and vapors within the package will open the resistance path and escape through the perforation.

10 Claims, 8 Drawing Figures

FIG. 1
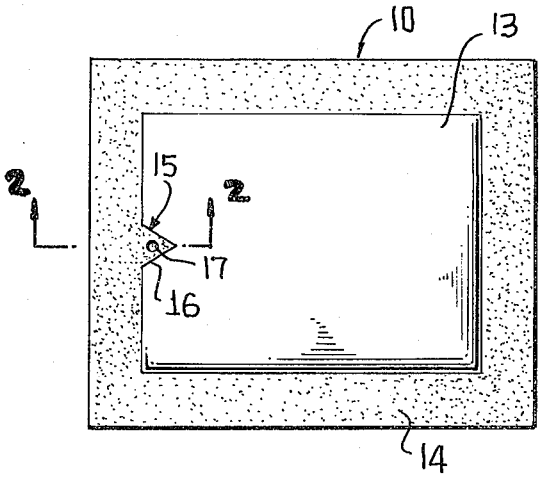
FIG. 2
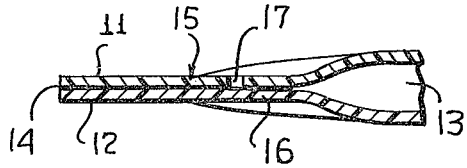
FIG. 3
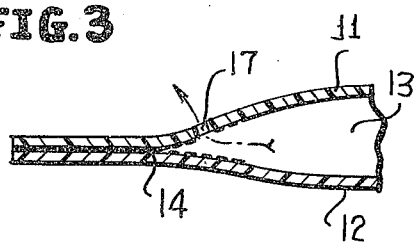
FIG. 4
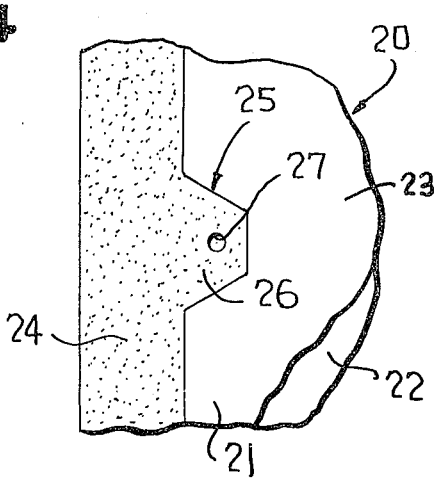
FIG. 5
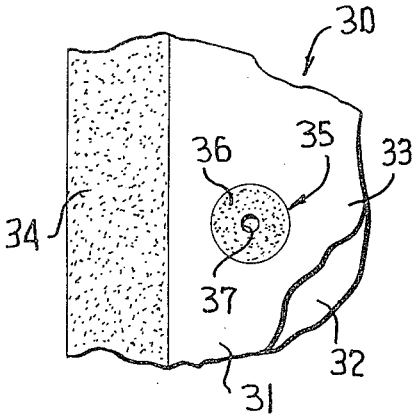
FIG. 6
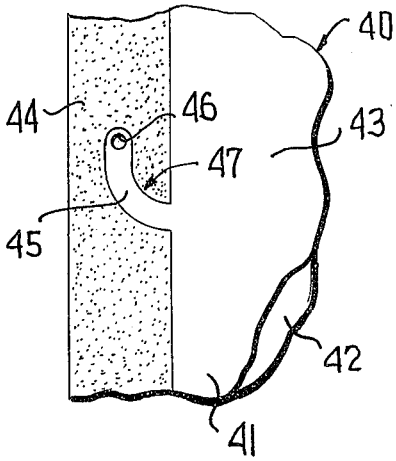
FIG. 7
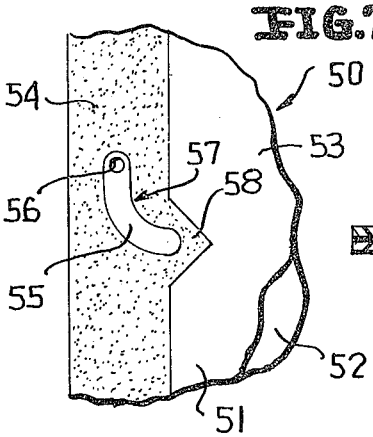
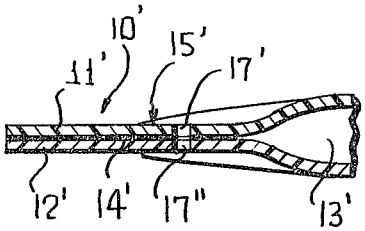
FIG. 8

VALVE FOR VENTED PACKAGE

This invention relates in general to new and useful improvements in valved packages, and more particularly to a vented package having valve means therein for automatically venting the package when excess pressure occurs therein.

Flat pouches, tetrahedrons, flat bottom bags, cartons, etc. made from flexible materials and employing an inside face-to-inside face seal between container wall portions, frequently contain products which under certain conditions of heat, age, moisture content, etc. form gases which can rupture the package walls or seals, expand shipping cases, or disfigure the appearance of an otherwise saleable package. The art is well developed with valving means comprising open channels intended to permit internal gases to escape without permitting entry of external contaminants. Many of these one-way valves, made up of one or more additional flexible sheets, are too costly and sophisticated for the simple function of venting at an approximately pre-established pressure. Certain wrinkles can form in valve channels which create a substantial opening for entry of external contaminants. Few, if any, of these so-called one-way valve functions with 100% reverse flow shut-off, even when operating at peak design efficiency. Because containers of the class described are usually constructed of costly laminates with rated moisture and gas barrier characteristics that are consistent with a projected shelf life, these visably open valve channels become a justified point of concern for both the product manufacturer and the product purchaser.

It is the general object of this invention to provide a vent valve for packages of the foregoing class that is simple in construction, low in costs, and which will render the full rated protection of the container material until the vent valve opens.

It is a further object of this invention that the venting valve will function at approximately a pre-determined internal pressure and that the rate of venting occurs at an approximate specified rate.

It is a still further object of this invention that embodiments of the invention incorporate constructional features which close off the venting when internal gas pressure is relieved below a predetermined limit.

The foregoing objects have been achieved according to this invention with a valve formed within a package made from two walls of flexible material, the valve comprising a perforation through at least one of the two package walls within the confines of an area where the two walls have been sealed together in inside face-to-inside face relation, and a resistance path to the perforation is openable by forces expanding the walls, whereby pressure is caused by the formation of gases, and vapors within the container open the resistance path and escape through the perforations.

With the above and other objects in view that will hereinafter appear, the nature of the invention will be more clearly understood by reference to the following detailed description, the appended claims and the several views illustrated in the accompanying drawings:

In the drawings:

FIG. 1 is a plan view of a package formed in accordance with this invention and incorporating one form of vent valve.

FIG. 2 is an enlarged fragmentary transverse sectional view taken along the line 2—2 of FIG. 1 and shows specifically the details of the vent valve.

FIG. 3 is an enlarged fragmentary sectional view similar to FIG. 2 and shows the vent valve in its open operative position.

FIGS. 4, 5, 6 and 7 are fragmentary plan views showing other forms of vent valves in accordance with this invention.

FIG. 8 is an enlarged fragmentary sectional view similar to FIG. 2 and shows a slightly modified form of vent valve construction.

Referring now to the drawings in detail, it will be seen that there is illustrated in FIG. 1 a vented package formed in accordance with this invention. The vented package is generally identified by the numeral 10 and basically is in the form of two walls 11,12 of flexible material which are sealed together about the periphery of the package so as to define a sealed enclosure 13. In the illustrated embodiment of the invention, the walls 11,12 are formed of separate sheets and are joined together by an inside face-to-inside face peripheral seal 14. It is to be understood, however, that the two walls 11,12 may be formed from a single sheet folded at an intermediate point upon itself and that the peripheral seal 14 need not extend along the line of fold although it is feasible, if desired, to permit the peripheral seal 14 to extend entirely about the periphery of the package 10 even under these circumstances.

It is to be understood that a product is placed within the sealed enclosure 13 and is hermetically sealed therein. When gases are generated within the sealed enclosure 13, the package 10 has a tendency to unduly bulge and if the pressure becomes too great, either the walls 11,12 will rupture or the peripheral seal 14 will rupture. Accordingly, the package 10 is provided with an automatic vent valve which is generally identified by the numeral 15. The vent valve 15 includes a sealed area 16 which is formed by sealing a localized portion of the walls 11,12 together in inside face-to-inside face relation. Within the sealed area 16, a perforation 17 through at least one of the walls 11,12 is formed. It is to be understood that the perforation 17 normally is not in communication with the sealed enclosure 13, and therefore, under normal conditions, no venting occurs.

It is to be understood that when the gaseous pressure within the sealed enclosure 13 builds up, the walls 11,12 move apart and begin to stress the seal of the sealed area 16. When the stress becomes sufficient, the walls 11,12 in the sealed area 16 begin to peel apart and eventually the sealed enclosure 13 comes into communication with the aperture or perforation 17 and the sealed enclosure 13 is vented to the atmosphere, as is shown in FIG. 3. It is to be understood that walls 11,12 can be flexible laminations, well known in the packaging industry, and the sealed area 16 can comprise a heat seal between heat sealing inner laminates of walls 11,12, respectively. It is to be further understood that walls 11,12 can peel apart in the sealed area 16 by the heat seal itself separating or by an inner laminate section in area 16 breaking away from one of the laminated walls, depending upon which is the path of least resistance. When the pressure within the sealed enclosure 13 has been relieved, the walls 11,12 due to the influence of the adjacent peripheral seal 14, has a tendency to close, thereby locking the perforation 17 against the ingress of gases.

At this time it is particularly pointed out that by carefully controlling the size of the perforation 17, the rate of venting of the package 10 may be controlled. Further, by controlling the size of the perforation 17, the ingress of gases can be controlled.

Referring now particularly to the vent valve 15, it is to be noted that the sealed area 16 is integrally formed with the peripheral seal 14 and projects into the sealed enclosure 13. Further, it is of a tapered construction and in the illustrated form is of a triangular outline. By having a very narrow starting point, the pressure required to effect the separation of the walls 11,12 in the sealed area 16 may be maintained at a predetermined minimum.

Referring now to FIG. 4, it will be seen that there is illustrated a modified form of vented package generally identified by the numeral 20. The package 20, like the package 10, is formed of two walls 21,22 which are connected together by a peripheral seal 24 to define a sealed enclosure 23. The package 20 is provided with a vent valve generally identified by the numeral 25, the vent valve 25 being of a construction similar to that of the vent valve 15. The vent valve 25 includes a perforation 27 formed through the wall 21 in the sealed area.

It is to be noted that the vent valve 25 differs from the vent valve 15 only in that the sealed area 26 is trapezoidal instead of triangular. By forming the sealed area 26 of a trapezoidal outline, a greater pressure is required within the sealed enclosure 23 so as to effect a separation of the walls 21,22 in the sealed area 26.

It is to be understood that the pressure required to result in the separation of the sealed area 26 will depend upon generally the width of the sealed area 26 at the inner end thereof. Thus, the size and configuration of the sealed area 26 may be varied so as to vary the pressure within the sealed enclosure 23 required to effect venting of the package 20.

Referring now to FIG. 5, it will be seen that there is illustrated another vented package generally identified by the numeral 30. The package 30, like the packages 10 and 20, is formed of two walls 31 and 32 which are joined together by means of a peripheral seal 34 so as to define a sealed enclosure 33. The package 30 also includes a vent valve 35 which is formed by a sealed area 36 spaced inwardly of the peripheral seal 34 and separate therefrom. The sealed area 36 is defined by a limited sealing together of the walls 31,32 in inside face-to-inside face relation. A perforation 37 is formed within the sealed area 36 through at least one of the walls 31,32 the perforation 37 being illustrated in the wall 31.

It is to be understood that as the walls 31,32 begin to separate due to internal gaseous pressure within the sealed enclosure 33, the sealed area 36 will separate and the perforation 37 will come into communication with the interior of the sealed enclosure 33 so as to vent gaseous pressure therefrom.

It is to be understood that as the gaseous pressure within the sealed enclosure 33 is relieved, the walls 31,32 will again return in substantially touching relation so as to substantially close off the perforation 37. It is also to be understood that the configuration of the sealed area 36 may be varied so as to vary the pressure required to effect the venting of the package 30.

Reference is now made to FIG. 6 wherein there is illustrated still another form of vented package in accordance with this invention, the vented package being generally identified by the numeral 40. Once again, the vented package 40 includes two walls 41,42 which are joined together by a peripheral seal 44 so as to define a sealed enclosure 43. The peripheral seal 44 is interrupted so as to define a preformed resistance path 45 opening outwardly from the sealed enclosure 43. At the inner end of the path 45 a perforation 46 is formed in at least one of the walls 41,42, the perforation 46 being illustrated as being formed in the wall 41.

It is to be understood that under normal packaging conditions, the portions of the seal 44 on opposite sides of the resisted path 45 will maintain the walls 41,42 in contact with one another and thus venting of the sealed enclosure 43 will not occur. However, when the pressure within the sealed enclosure 43 builds up, the pressure will be sufficient so as to separate the walls 41,42 along the resistance path 45 and place the sealed enclosure 43 into communication with the perforation 46 so as to vent the sealed enclosure 43.

It is to be understood that the pressure required to open the resistance path 45 will vary depending upon the configuration and dimensions of the resistance path 45. Also, the rate of pressure venting through the perforation 46 will vary depending upon the size of the perforation. Finally, it is to be noted that inasmuch as the resistance path 45 is defined by the peripheral seal 44 and thus there is always a tendency for the walls 41 and 42 to come back into closed relation due to inherent stresses, as soon as proper venting of the package 40 occurs, the resistance path 45 will again become sealed so as to prevent ingress of air and gases through the perforation 46.

Reference is now made to FIG. 7 wherein there is illustrated a still further form of package generally identified by the numeral 50. The package 50 is very similar to the package 40 and includes a pair of walls 51,52 of flexible material joined together by a peripheral seal 54 so as to define therebetween a sealed enclosure 53. A peripheral seal 54 is so configurated so as to define a resistance path 55 therein. The resistance path 55 leads from a point adjacent the sealed enclosure 53 to a perforation 56 formed through one of the walls 51,52, the perforation 56 being illustrated as formed in the wall 51.

The vent valve of the package 50, which is identified by the numeral 57 differs from the vent valve 47 of the package 40 in that the resistance path 55 is initially sealed from communication with the sealed enclosure 53 by means of a sealed area 58. However, when the pressure within the package 50 increases to the point that the walls 51,52 separate sufficiently, they will peel apart at seal 58 of the sealed area 53 and place the resistance path 55 into communication with the sealed enclosure 53. At this time it is pointed out that the seal 58 is an inner face-to-inner face seal.

The configuration of the sealed area 58 may be varied so as to vary the internal gaseous pressure within the sealed enclosure 53 required to effect a venting of the package 50.

Reference is now made to FIG. 8 wherein there is illustrated still a further modified package construction identified by the numeral 10'. The package 10' is substantially identical to the package 10 except in lieu of a single perforation 17', the package 10' including a second perforation 17''. The perforations 17' and 17'' are formed in alignment in the walls 11',12', respectively, and a double venting occurs once the seal of the vent valve 15' is ruptured.

It is also to be understood that the vent valves 25,36,47 and 57 may incorporate a perforation to each of the walls of the respective package in the same manner as that illustrated and described with respect to FIG. 8.

It is to be understood that the various vent valves need not permit atmospheric contamination to enter the package after the vent seal opens and most of the excess internal pressure has escaped. It is to be noted that products that generate these internal pressures generally continue to do so at a lesser rate to keep the direction of flow from interior through a valve hole of the type formed by a small needle prick. Such a tiny hole constitutes such a very small area that even if the package interior is entirely deflated, the penetration of moisture vapor per square inch of package surface is acceptable or negligible. It is to be understood, however, that the vent valves 47,57 will assure a positive sealing of the package after venting has occurred.

It will be apparent from the construction of the vent valves that the necessary perforation or perforations may be formed in several manners. These include the perforation of a single wall prior to the assembly of the walls. This method would be utilized in the case of the single perforation shown, for example, in FIG. 2. However, when double perforations are provided, as is shown in FIG. 8, the necessary seal may be formed and thereafter the sealed area penetrated by means of a suitable perforator device such as a small diameter needle.

Depending upon the control required, the perforation through the sealed area is made either while the material of the sealed area is hot or after it has a chance to cool. If it is made while it is hot, the material of the walls may adhere to the needle and when the needle is withdrawn, the perforation of the second punctured wall may be substantially closed. On the other hand, when the perforation is formed while the material is cold, a positive double perforation will be formed.

It is to be understood that the manner in which the perforation or perforations are formed in each package is immaterial. It is also to be understood that the specific location and configuration of the sealed area of each vent valve may be varied depending upon the venting characteristics which may be desired. It will be readily apparent that if the vent valve is placed in a corner of the package, for example, the venting pressure will be greatly decreased.

Although several modifications of the vent valve of this invention have been specifically illustrated and described herein, it is to be understood that other modifications of the vent valve may be made without departing from the spirit and scope of the invention, as defined by the appended claims.

I claim:

1. A vented package comprising two walls of flexible material joined together to define a sealed enclosure, said walls having an area wherein at least a portion of said walls are joined together in an inside face-to-inside face seal, said face seal including a sealed enclosure defining portion and an extension projecting into said sealed enclosure, and valve means for venting excess gas pressure from within said sealed enclosure, said valve means including a perforation through at least one of said walls in said seal area, and a resistance path to said perforation from within said sealed enclosure through said seal extension, said resistance path being of the type openable in response to gaseous pressure within said sealed enclosure for venting gases through said perforation, said resistance path being normally closed by a portion of said seal extension.

2. The vented package of claim 1 wherein said seal extension decreases in width inwardly of said peripheral seal.

3. The vented package of claim 2 wherein said seal extension is triangular in outline.

4. The vented package of claim 2 wherein said seal extension is trapezoidal in outline.

5. The vented package of claim 1 wherein said resistance path is defined by unsealed portions of said walls within said seal.

6. The vented package of claim 1 wherein said perforation is formed in said sealed enclosure defining portion of said seal and said resistance path is defined by an unsealed portion between said walls within the confines of said face seal, said unsealed portion extending into said seal extension.

7. The vented package of claim 6 wherein said perforation is offset from said seal extension and said unsealed portion is self closing.

8. The vented package of claim 7 wherein said unsealed portion is arcuate in outline.

9. The vented package of claim 7 wherein said unsealed portion is arcuate in outline and extends through an angle of substantially ninety degrees.

10. The vented package of claim 1 wherein said perforation is in the form of a needle prick.

* * * * *